US007966841B2

(12) United States Patent
Lowenstein et al.

(10) Patent No.: US 7,966,841 B2
(45) Date of Patent: Jun. 28, 2011

(54) HEAT AND MASS EXCHANGER

(75) Inventors: Andrew Lowenstein, Princeton, NJ (US); Marc J. Sibilia, Princeton, NJ (US); Jeffrey A. Miller, Hopewell, NJ (US); Thomas Tonon, Princeton, NJ (US)

(73) Assignee: AIL Research, Inc, Princeton, NJ (US)

( * ) Notice: Subject to any disclaimer, the term of this patent is extended or adjusted under 35 U.S.C. 154(b) by 0 days.

(21) Appl. No.: 11/818,711

(22) Filed: Jun. 14, 2007

(65) Prior Publication Data

US 2008/0110191 A1 May 15, 2008

Related U.S. Application Data

(63) Continuation of application No. 11/264,590, filed on Nov. 1, 2005, now Pat. No. 7,269,966, which is a continuation of application No. 11/103,136, filed on Apr. 11, 2005, now abandoned.

(60) Provisional application No. 60/561,182, filed on Apr. 9, 2004.

(51) Int. Cl.
*F25D 23/00* (2006.01)

(52) U.S. Cl. ..... 62/271; 62/305

(58) Field of Classification Search ..... 62/271, 62/91, 94, 272, 285, 259.4, 121, 171, 304, 62/305; 165/148, 115, 911, 133, 179, 184; 261/156, 157

See application file for complete search history.

(56) References Cited

U.S. PATENT DOCUMENTS

| | | | | |
|---|---|---|---|---|
| 2,183,136 | A * | 12/1939 | Downs | 62/94 |
| 2,274,034 | A * | 2/1942 | Broadhurst | 62/311 |
| 3,528,496 | A * | 9/1970 | Kun | 165/166 |
| 5,397,474 | A * | 3/1995 | Henry | 210/615 |
| 5,597,039 | A * | 1/1997 | Rieger | 165/133 |
| 5,761,908 | A * | 6/1998 | Oas et al. | 62/3.2 |
| 6,213,196 | B1 * | 4/2001 | Ozaki et al. | 165/140 |
| 6,446,625 | B1 * | 9/2002 | Tinari | 126/617 |
| 6,605,238 | B2 * | 8/2003 | Nguyen et al. | 252/502 |
| 6,702,004 | B2 * | 3/2004 | Stratman et al. | 165/115 |
| 6,748,759 | B2 * | 6/2004 | Wu | 62/305 |
| 2003/0024692 | A1 * | 2/2003 | Wu | 165/115 |
| 2003/0066634 | A1 * | 4/2003 | Valenzuela et al. | 165/148 |

FOREIGN PATENT DOCUMENTS

JP 6-117789 A * 4/1994

* cited by examiner

*Primary Examiner* — Mohammad M Ali
(74) *Attorney, Agent, or Firm* — Watov & Kipnes, P.C.

(57) ABSTRACT

A mass and heat exchanger includes at least one first substrate with a surface for supporting a continuous flow of a liquid thereon that either absorbs, desorbs, evaporates or condenses one or more gaseous species from or to a surrounding gas; and at least one second substrate operatively associated with the first substrate. The second substrate includes a surface for supporting the continuous flow of the liquid thereon and is adapted to carry a heat exchange fluid therethrough, wherein heat transfer occurs between the liquid and the heat exchange fluid.

25 Claims, 15 Drawing Sheets

HEAT AND MASS EXCHANGER

RELATED APPLICATIONS

This is a continuation application of U.S. patent application Ser. No. 11/264,590 filed Nov. 1, 2005 now U.S. Pat. No. 7,269,966 which is a continuation application of U.S. patent application Ser. No. 11/103,136 filed Apr. 11, 2005 now abandoned which claims priority to U.S. Provisional Patent Application Ser. No. 60/561,182 filed Apr. 9, 2004.

GOVERNMENT INTEREST

The invention described and claimed herein may be manufactured, used and licensed by or for the United States Government.

This invention is made with Government support under SBIR Grant No.DE-FG02-03ER83600 awarded by the Department of Energy. The Government has certain rights in this invention.

FIELD OF THE INVENTION

The present invention relates to thermodynamic devices, and more particularly to a heat and mass exchanger.

BACKGROUND OF THE INVENTION

Proper ventilation and regulation of humidity are essential for maintaining healthy and comfortable air quality indoors. However, these two factors can be in conflict in certain situations. For example, when ventilation rates are increased to improve indoor air quality, humidity can soar to levels that are uncomfortable or even unhealthy. Nearly all residential heating, ventilation and air conditioning (HVAC) systems are capable of regulating air temperature within acceptable ranges. However, few systems are able to effectively regulate air humidity.

People living in the eastern portion of the United States are familiar with the problem of less than adequate humidity control. A rainy summer night with temperatures in the range of upper 60s to low 70s can have a humidity ratio above 0.015 lb/lb (dewpoint above 68° F.). Since the sun is down and the air temperature is moderate, the cooling load on the house is almost zero. If the air conditioner does not run, the absolute humidity within the house will equal or exceed that of the outdoors. For a 75° F. indoor temperature, the relative humidity will be at least 80%—a level that is not only uncomfortable, but exceeds the 70% threshold at which mold and mildew proliferate.

Conventional HVAC equipment under such conditions is limited in its ability to restore comfortable air quality. All conventional systems dehumidify by cooling air below its dewpoint. A conventional vapor compression dehumidifier operates by cooling the air to condense the water vapor, and thereafter re-heating the air. However, this process is generally inefficient.

Desiccants provide a very efficient means to control indoor humidity independent of temperature. The concepts described herein integrate desiccant technology with a vapor-compression air conditioner to produce a system that yields an enhanced dehumidifier exhibiting higher efficiency.

Attempts have been made to develop vapor-compression air conditioners that directly coupled a liquid desiccant to both the evaporator and condenser of the air conditioner. The earliest work was done by John Howell and John Peterson at the University of Texas. The concept involved spraying desiccant directly onto the air conditioner's evaporator and condenser. The process air stream that flows through the evaporator is simultaneously cooled and dehumidified as the desiccant absorbs water vapor from the air. The cooling air that flows through the condenser, in addition to carrying away the heat rejected by the air conditioner, regenerates the desiccant by carrying away water desorbed by the warm desiccant.

Although Howell and Peterson modeled the performance of a liquid-desiccant vapor-compression air conditioner (LDVCAC) that used lithium chloride, the prototype that they built and tested used ethylene glycol. Unfortunately, the use of glycol as a desiccant was impractical. All glycols have a finite vapor pressure. In both the evaporator and the condenser, glycol will evaporate into the air streams, thus undesirably requiring periodic recharging of the system.

More recently, the Drykor Corporation of Israel introduced several models of liquid-desiccant vapor-compression air conditioners (LDVCAC) based on the teachings of U.S. Published Patent Application No. 2002/0116935. The Drykor technology uses lithium chloride as the liquid desiccant. This is an improvement over the Howell and Peterson work since solutions of all ionic salts including lithium chloride do not "evaporate" the salt, i.e., the vapor pressure of an ionic salt is essentially zero.

In the Drykor system, the liquid desiccant is first cooled in the evaporator in the form of a refrigerant-to-desiccant heat exchanger, and then the cool desiccant is delivered to a porous bed of contact media where the process air is dried and cooled. Similarly, the desiccant is regenerated by first heating it in the condenser in the form of a second refrigerant-to-desiccant heat exchanger and then flowing the warm desiccant over a porous bed of contact media where a stream of ambient air is flowing therethrough.

The American Genius Corporation (AGC) is marketing a liquid desiccant air conditioner that functions similarly to the Drykor unit. The AGC system uses a mixture of lithium chloride and lithium bromide as the liquid desiccant.

In one important way, the LDVCAC of Howell and Peterson is superior to those of both Drykor and AGC in that the Howell and Peterson system uses the evaporator and condenser of the vapor-compression air conditioner as the contact surface for mass and heat exchange between the desiccant and the air streams, whereas the other two systems either heat or cool the desiccant and then, in separate sections bring the desiccant in contact with the air streams. The LDVCACs of Drykor and AGC therefore introduce additional temperature drops that degrade the efficiency of the air conditioners.

The LDVCAC of Howell and Peterson, however, cannot be easily used with aqueous solutions of either lithium chloride or lithium bromide because these solutions are very corrosive to the metals that are commonly used to make evaporators and condensers. While the evaporator and condenser can be made from an expensive alloy that resists corrosion, the resulting air conditioner would be too expensive to sell in the broad HVAC market. Howell and Peterson suggested that corrosion-resistant metallic tubes with plastic or ceramic-coated fins may be a compromise surface for combined heat and mass transfer. However, these approaches of protecting the evaporator and condenser from corrosion have important limitations: plastics have a low surface energy and so are not easily wetted by liquids; and ceramics are very difficult to apply in the thin pin-hole-free coatings needed in this application.

All LDVCACs must also prevent droplets of desiccant from being entrained by the air that flows through the dehumidifying and the regenerating sections of the air conditioner. While it is possible to add a droplet filter or demister at the air exits from both the dehumidifying and regenerating sections of the LDVCAC so that droplets do not escape from the system, this approach will create large maintenance requirements associated with keeping the filters unblocked by liquid, and increase the pressure drop that must be overcome by the system's fans.

U.S. Pat. Nos. 5,351,497 and 6,745,826 teach that desiccant droplets can be suppressed in a mass and heat exchanger by flowing very low rates of desiccant onto the surfaces of the mass and heat exchanger, and preparing the surfaces so that the low flow of desiccant still provides uniform coverage. This approach to suppressing droplets cannot be used in the LDVCACs proposed by Howell-Peterson, Drykor or AGC. As previously described, in the Drykor and AGC systems the desiccant is first heated or cooled in a refrigerant-to-desiccant heat exchanger and then the desiccant is brought in contact with air in a bed of porous contact media. The bed is adiabatic (i.e. the bed does not exchange thermal energy with the desiccant). The flow rate of desiccant, therefore, must be high enough to prevent the temperature of the desiccant from either decreasing too much (in the regenerating section where the desorption of water is endothermic) or increasing too much (in the dehumidifying section where the absorption of water is exothermic). This prevents the use of Lowenstein's low-flow approach to suppressing droplets.

In the Howell-Peterson LDVCAC, the contact surface on which the desiccant and air exchange heat and mass is either the surface of the evaporator or the condenser. Thus, if these heat exchangers have metallic fins, the desiccant will be continually cooled or heated as it interacts with the air. However, the Howell-Peterson LDVCAC does not readily achieve uniform distribution of the desiccant on the surfaces of the evaporator and condenser. As noted earlier, Howell and Peterson propose that the evaporator and condenser can be coated with plastic or ceramic to protect them from a corrosive desiccant. However, these coatings do not enhance and may deter the spreading of the desiccant over the external surfaces of the heat exchangers. Furthermore, Lowenstein's low-flow approach to suppressing droplets would be difficult to implement with plain plastic surfaces.

Howell and Peterson's suggestion that corrosion-resistant metallic tubes be used with plastic fins is also disadvantageous because of the poor thermal conductivity of plastics. Although a plastic fin can be used to provide contact between the liquid desiccant and the air that flows over the fin, the fin will not effectively heat or cool the desiccant. It is essential in a heat and mass exchanger that the liquid that flows on the fins periodically comes into close thermal contact with the metallic tubes. We have observed that the most common configuration for finned-tube HVAC heat exchangers (e.g. FIG. 3 of U.S. Pat. No. 4,984,434), in which the tubes pass through holes in the fins, will not effectively heat or cool the desiccant if the fins are plastic, even if the surface of the fins are treated so that uniform films of desiccant are created. This is because the plastic fins are poor thermal conductors and they provide a path for the desiccant to bypass the tube i.e., the liquid desiccant can flow on a fin from the top of the evaporator/condenser to the bottom without ever coming in thermal contact with a metallic tube.

The evaporator and the condenser of a LDVCAC are heat and mass exchangers whereby in the form of an evaporator both thermal energy (heat) and water vapor (mass) are absorbed from an air stream, and whereby in the form of a condenser both heat and mass are added to an air stream. Many processes in industry rely on mass and heat exchangers, and the invention can be used to both lower the cost and improve the efficiency of some of these processes. Examples of processes that may benefit from the invention are: (1) evaporative condensers for air conditioners and refrigeration systems, (2) gas scrubbers used in emission control systems and gas purification systems, (3) desalination plants, (4) driers, distillers and concentrators where water or other volatile species are removed from a less-volatile liquid, and (5) absorption chillers.

The heat and mass exchangers for the preceding processes are commonly configured as an array of tubes that can be oriented vertically or horizontally. If the process is endothermic, as would be the case for most evaporation, distillation or desorption processes, the tubes are heated internally through a fluid or condensing vapor such as steam. The second fluid that is to be evaporated or that contains the volatile specie that is to be desorbed flows as a film over the outside of the tubes.

In at least one configuration of a heat and mass exchanger, which is described by Goel and Goswami in the Fall 2004 Newsletter of the ASME Solar Energy Division, the external surface of the tubes is enhanced with a screen, mesh or fabric. For a vertical column of spaced-apart horizontal tubes, the screen, mesh or fabric is interlaced with the tubes so that it alternately contacts the left and right sides of the tubes at a limited region of contact. As an absorbing fluid flows downward in the screen, mesh or fabric, it contacts each tube in the column in this limited region of contact, but the liquid is not forced to flow around the tube.

Accordingly, there is a need for a heat and mass exchanger for use in a thermodynamic device that is designed to overcome the limitations described above. There is a need for a heat and mass exchanger that can carry a liquid on the surface of the exchanger that either absorbs, desorbs, evaporates or condenses one or more gaseous species from or to a surrounding gas such as a process air stream, while maintaining the temperature of the liquid at a desired level to improve the efficiency of the heat and mass exchange. There is a further need for a heat and mass exchanger compatible with corrosive liquids such as liquid desiccants, and which is capable of suppressing droplet formation of the liquid, while maintaining both elevated levels of efficiency and ease of maintenance.

SUMMARY OF THE INVENTION

The present invention is directed to a heat and mass exchanger designed to exchange a gas with a liquid, while independently maintaining the temperature of the liquid so as to maintain an efficient exchange. By way of example, the heat and mass exchanger of the present invention utilizes a liquid desiccant that is capable of altering the water vapor content of a process air stream in an efficient manner. The heat and mass exchanger includes a substrate having a surface capable of supporting the flow of the liquid thereon in contact with a gas, the surface further functioning to enhance the exchange of thermal energy between the liquid and a heat exchange fluid (gas or liquid or the same undergoing a phase change) that flows within the heat and mass exchanger.

In one aspect of the invention, there is provided a heat and mass exchanger for exchanging heat and mass between a gas and a liquid comprising:

- a plurality of substantially parallel tubes in spaced apart relationship including at least one upper tube which is above and spaced apart from at least one lower tube, said tubes having an outer surface;
- a substrate positioned in the space between the upper and lower tubes, said substrate comprising at least one surface in contact with the gas and providing at least one pathway for the liquid to flow by gravity from the upper to the lower tubes without forming droplets; and that cause a substantial portion of the liquid to flow onto the outer surface of at least one lower tube;

a liquid supply assembly for delivering the liquid to the at least one upper tube; and means for internally heating or cooling at least some of the tubes.

In another aspect of the present invention, there is provided an extruded plate having a longitudinal axis and opposed end portions for use in a heat and mass exchanger comprising:

a front wall and a rear wall spaced apart from each other;

a plurality of parallel channels in the space between the front and rear walls running between the opposed end portions of the plate, wherein adjacent channels are separated from each other by webs;

fluid entry means for enabling a fluid to enter at least some of the channels through at least one of the front and rear walls;

fluid exit means for enabling the fluid to exit at least some of the channels through at least one of the front and rear walls;

means for preventing the fluid from entering or leaving the channels at the opposed end portions; and fluid communication means through at least some of the webs creating a path for fluid to flow within the plate from the fluid entry means to the fluid exit means of the plate.

In a further aspect of the invention there is provided a heat and mass exchange assembly comprising:

a plate assembly comprising a plurality of spaced apart plates, each plate having an upper region and a lower region;

means for internally heating or cooling each plate;

a wettable substrate positioned in the spaces between adjacent plates and in contact with the adjacent plates at a plurality of locations, said wettable substrate allowing a gas to move through the spaces between the plates; and a liquid supply assembly comprising a source of a liquid and means for delivering the liquid from the source to the upper regions of the plates.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

Figure 1:
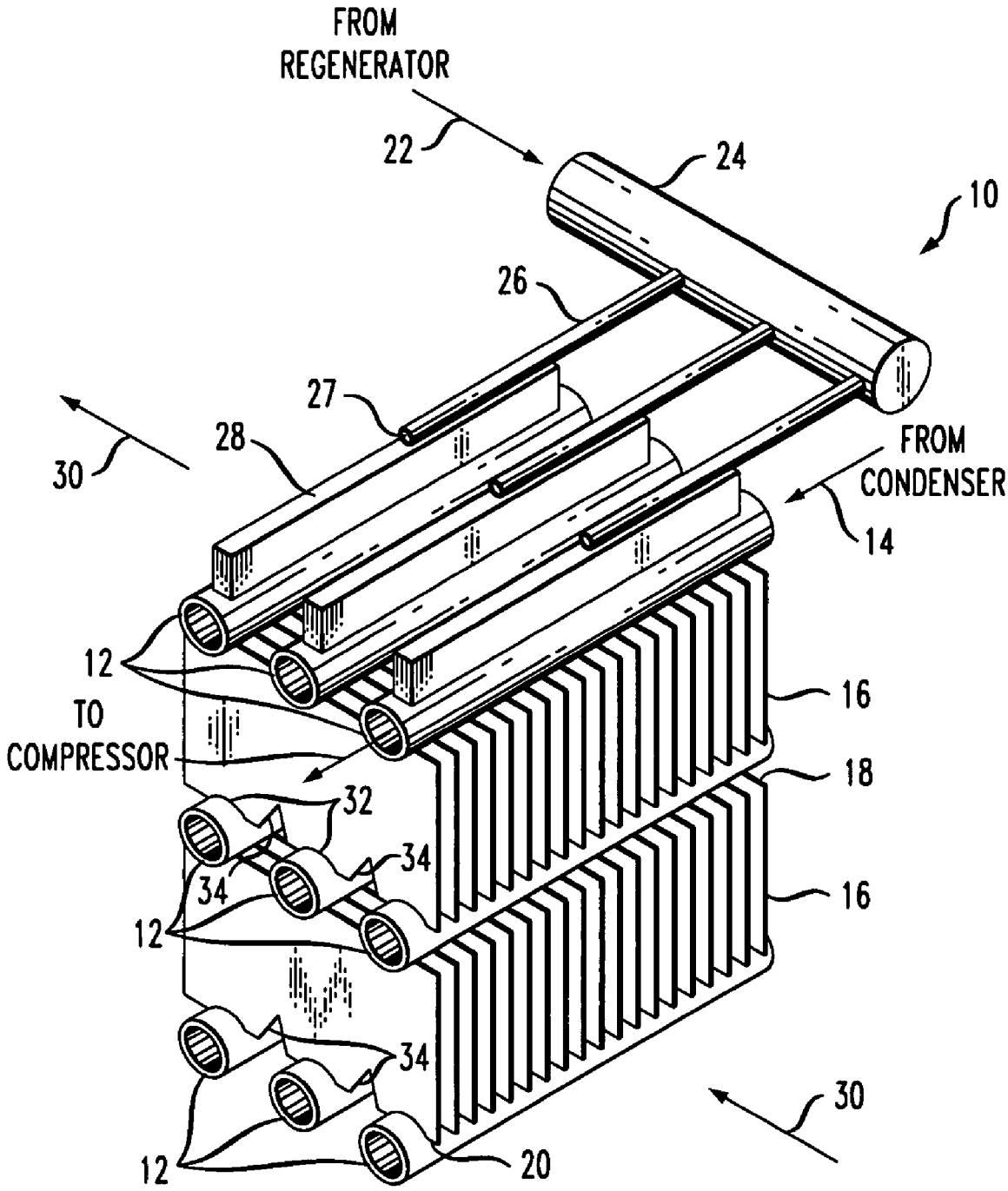
FIG. 1 is a perspective view of a heat and mass exchanger in the form of an evaporator for one embodiment of the present invention.

The present invention is directed to a heat and mass exchanger that can readily be implemented in air conditioning, dehumidification, and other applications that require the transfer of heat and mass between corresponding fluids. In one embodiment, the heat and mass exchanger of the present invention is adapted to facilitate the transfer of a mass in the form of a water vapor between a process air stream and a liquid desiccant, while at the same time, regulating the exchange of heat. The heat and mass exchanger of the present invention is resistant to corrosive substances including liquid desiccants, and is designed to suppress undesirable droplet formation of the liquid, control the temperature of the liquid, and exhibit good thermodynamic efficiency. The heat and mass exchanger of the present invention is cost efficient to fabricate and implement, and requires low maintenance.

The heat and mass exchanger of the present invention can be incorporated into a variety of thermodynamic devices including, but not limited to, evaporative condensers for air conditioners and refrigeration systems, gas scrubbers used in emission control systems and gas purification systems, desalination plants, driers, distillers and concentrators where water or other volatile species is removed from a less-volatile liquid, and absorption chillers.

In one embodiment of the present invention, there is provided a heat and mass exchanger that includes a substrate having a surface capable of supporting a flow of a liquid such as a liquid desiccant thereon while in contact with a gas such as a process air stream wherein the liquid desiccant is capable of modifying the content of a component of the gas such as a water vapor, and a heat exchange element having a surface capable of supporting the flow of the liquid desiccant thereon and a heat exchange fluid flowing therein wherein heat energy is transferred between the liquid desiccant and the heat exchange fluid. The substrate is preferably made from a material having a thermal conductivity of less than 10 w/m-C.

Although not limited to this application, the detailed design and operation of the present invention, namely a heat and mass exchanger, will be described as it is applied to an evaporator of a liquid desiccant vapor compression air conditioner (LDVCAC). An evaporator operates to allow a gas such as a process air stream to pass therethrough in contact with a liquid desiccant, and absorb water vapor and heat from the passing process air stream. The heat is absorbed in the evaporator by a heat exchange fluid delivered from a condenser in the form of a refrigerant liquid. The heat exchange fluid is metered through a control valve or capillary tube to the evaporator. The pressure within the evaporator is maintained at a low level by a compressor. At low pressure, the heat exchange fluid in the form of a liquid begins to boil, and absorbs heat from the liquid desiccant and from the process air stream. The reverse process occurs in the heat and mass exchanger operating as a condenser.

Referring to FIG. 1, an evaporator 10 is shown for one embodiment of the present invention. The evaporator 10 comprises heat exchange tubes 12 for carrying therethrough a heat exchange fluid 14 in the form of a coolant or evaporating refrigerant, for example. The heat exchange tubes 12 are shown circular in cross section but may have other shapes including non-circular cross section shapes as desired including an elongated cross-section with a major axis of the cross-section in a vertical orientation as shown specifically in FIG. 8.

The tubes 12 are arranged horizontally in rows of three stacked upon each other in spaced apart relationship thus forming corresponding columns of tubes. A plurality of substrates into the form of spaced-apart fins 16 are disposed between adjacent rows of tubes 12 which separates upper tubes from lower tubes. The number of tubes 12 in each row, the number of rows of tubes 12, and the number of fins 16 are not limited to those shown herein, and may be modified or adjusted to meet the requirements of the application. The fins 16 are arranged to be at least substantially parallel to one another, and preferably equally spaced apart with the space between adjacent fins 16 larger than the thickness of the fin 16. The fins may be planar, bowed, corrugated or other suitable shapes.

The fins 16 shown in the embodiment of FIG. 1 are arranged at least substantially perpendicular to the longitudinal axis of the tubes 12. The fins include top and bottom edge portions 18 and 20 positioned proximate to the tubes 12. The tubes 12 may be in contact or separated by a small gap from the corresponding edges 18 and 20, respectively, of the fins 16.

A liquid desiccant 22 delivered from a regenerator (not shown) by a distribution manifold 24 is carried to distribution tubes 26. Suitable liquid desiccants may be selected from lithium chloride, lithium bromide, calcium chloride, potassium acetate and the like. The regenerator (not shown) functions to drive off excess water from the liquid desiccant that may be present prior to delivery to the evaporator 10. The liquid desiccant 22 is released from the distribution tubes 26 through outlets 27 onto corresponding porous distribution pads 28. The distribution pads 28 are preferably composed of a porous material such as open cell foams, non-woven fabrics and the like. The purpose of the pad is to spread the liquid over a relatively large area from a liquid source of smaller area to facilitate distribution of the liquid about the tubes. Each distribution pad 28 is positioned in contact with the corresponding tube 12. The liquid desiccant 22 disperses throughout the pad 28 and eventually flows onto the outer surface of the top row of the tubes 12. Through selection of thickness and porosity, the distribution pads 28 can be adapted to uniformly distribute the liquid desiccant 22 over at least a substantial portion of the outer surface of the tubes 12.

In another embodiment of the present invention, where the spacing between the tubes 12 is sufficiently close to avoid dripping, it may be preferable to utilize a single distribution pad (not shown) extending across the span of the tubes 12. The liquid desiccant 22 is delivered to the single distribution pad via spray nozzles (not shown) or drip pans (not shown). The use of spray nozzles or drip pans may require the use of baffles or partitions constructed around the distribution pad and the spray nozzles or drip pans to prevent the process air stream 30 from picking up the sprayed droplets of liquid desiccant 22.

Referring back to FIG. 1, the liquid desiccant 22 flows around the outer surface of the top row of tubes 12, and is cooled by contact with the tubes 12. Drawn downward by gravity, the liquid desiccant 22 flows to the top of the adjacent fins 16. The liquid desiccant 22 spreads across the outer surface of the fins 16 as a continuous flow without undesirably forming drips or droplets. A process air stream 30 that is to be cooled and dried is passed through the spaces between the fins 16 and around the tubes 12. The process air stream 30 may be introduced horizontally, vertically or at an angle to the evaporator 10. The process air stream 30 comes into contact with the liquid desiccant 22. The liquid desiccant 22 absorbs the heat and water vapor from the process air stream 30. The process air stream 30 leaving the evaporator 10 possesses a lower water content, while maintaining at least the same or lower temperature than entering the evaporator 10.

Since the water absorbing process is exothermic, the temperature of the liquid desiccant 22 increases as it flows down the outer surface of the fin 16 in contact with the process air stream 30. As a result of the temperature increase, the residence time of the liquid desiccant on the fins 16 must be controlled because the ability of the liquid desiccant 22 to absorb water vapor is diminished, and if the temperature exceeds a certain threshold level, the liquid desiccant 22 stops absorbing water vapor. Therefore, the distance between the top edge 18 and the bottom edge 20 of the fins 16 is selected to prevent the liquid desiccant 22 from exceeding the temperature threshold prior to coming into contact with and being cooled by the next row of tubes 12.

At this point, the liquid desiccant 22 reaches the next row of tubes 12 and is cooled by the heat exchange fluid 14 flowing through the tubes 12. The temperature of the liquid desiccant 22 is lowered, which enhances the ability of the liquid desiccant 22 to absorb more water vapor. This process of the liquid desiccant 22 being cooled while on the tubes 12, followed by the absorption of heat and water vapor while on the fins 16 is repeated several times as the liquid desiccant 22 flows from the top of the evaporator 10 to the bottom. When the liquid desiccant 22 reaches the bottom, the water-containing liquid desiccant 22 is collected in a reservoir (not shown) for delivery back to the regenerator (not shown) for re-charge and re-use.

As shown in FIG. 1, the top and bottom edges 18 and 20 of the fins 16 include contoured edge portions 32 that match the curvature of the tubes 12. This enables the fins 16 to be securely seated therebetween, while facilitating the flow of the liquid desiccant 22 between the tube 12 and the corresponding edge 18 or 20 of the fin 16.

Applicants have observed that a fillet of liquid desiccant forms where the edge 18 or 20 of the fin 16 is positioned in proximity to the tube 12. The fillet of relatively thick liquid desiccant 22 forms a region where the liquid desiccant 22 flows freely, but due to the thickness, poor thermal contact is made with the tube 12 and therefore only small amounts of heat are exchanged between the liquid desiccant 22 and the tube 12. As a result, the liquid desiccant 22 passing through the fillet is not effectively cooled upon contact with the tube 12. Thus, if the contoured edge portions 32 extend too far around the circumference of the tube 12 and no provision is made to prevent a fillet from forming, the contoured edge portions 32 form a path for the liquid desiccant 22 to flow around the tube 12 without being cooled.

The fins 16 further include drip preventing means to prevent the liquid desiccant from dropping off of the substrate. As shown in FIG. 1, the fins 16 include notches 34 located at the bottom edges 20 of the fins 16 between adjacent tubes 12. The notches 34 may include inclined edge portions that greatly reduce the tendency of the liquid desiccant 22 to drip off the bottom edge 20, and function to channel the downward-flowing liquid desiccant 22 towards the adjacent tube 12. In this manner, the liquid desiccant 22 is prevented from accumulating along the edge 20 of the fin 16 away from the tube 12 and dripping between the tubes 12.

The fins 16 are composed of a suitable material that facilitates wetting of the liquid desiccant 22 on substantially the entire surface or selected portions thereof, and which provides a suitable wicking surface for allowing the liquid desiccant 22 to flow uniformly over the fin 16. Such suitable materials are in the form of screens, meshes, non-woven sheets and the like typically made from fibers of plastics, metal, carbon, glass, ceramic, and cellulose. The fins 16 may be made in the form of thin films in which grit or fibers are adhered thereto which may be selected from plastic, metal, carbon, glass, ceramic, minerals, cellulose, and the like. In one embodiment the fins comprise a thin film of plastic material of less than 15 mils, and a layer of wicking material on each side of the thin film.

In the present embodiment, the evaporator 10 is constructed to facilitate the removal of the fins 16 for simple replacement, while keeping the evaporator 10 at least substantially intact. The fins 16 can be easily slipped out from between the tubes 12 and thereafter replaced.

Figure 2:
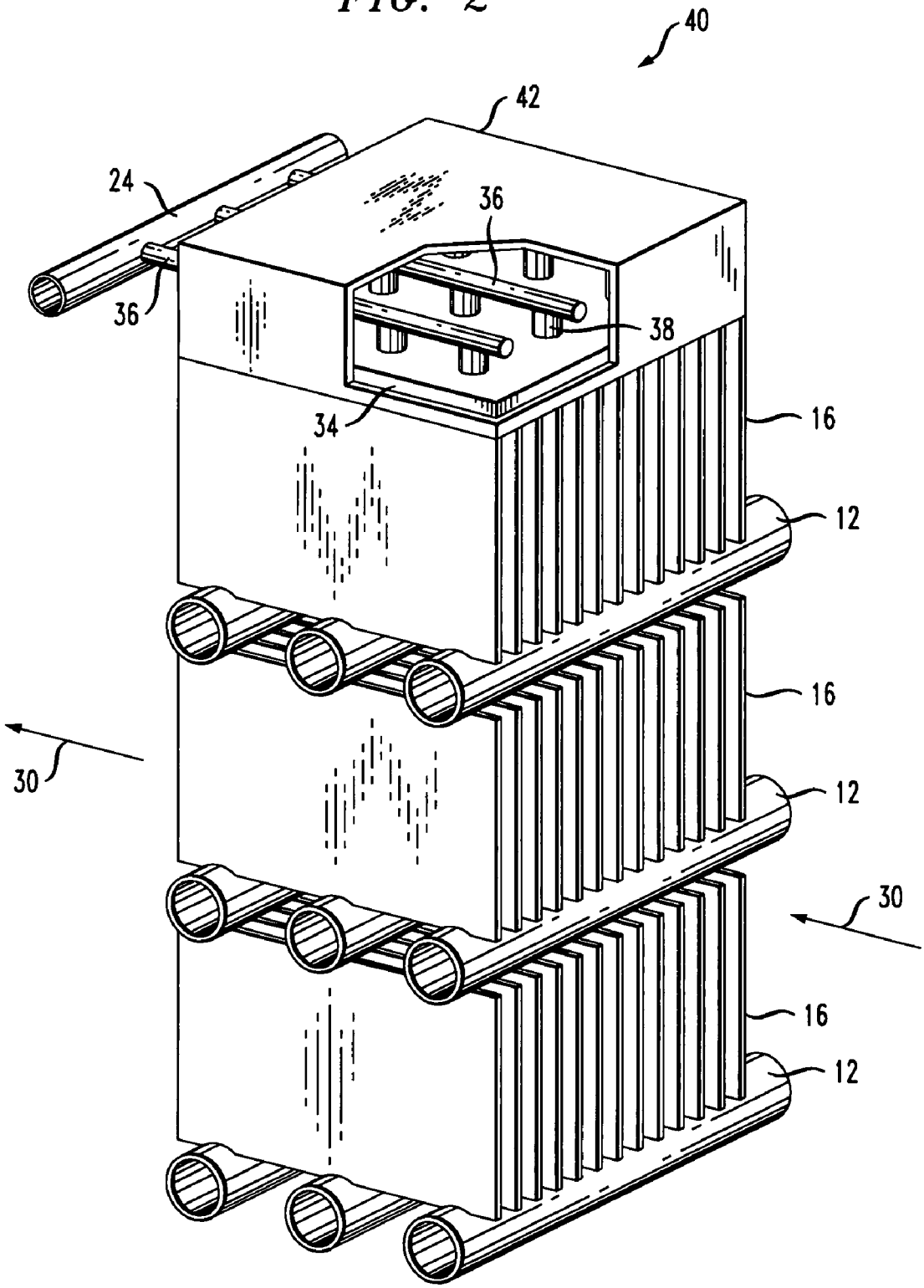
FIG. 2 is a perspective view of a heat and mass exchanger in the form of an evaporator for a second embodiment of the present invention.

Referring to FIG. 2, an evaporator 40 is shown for a second embodiment of the present invention. The evaporator 40 is similar to the evaporator 10 except for the liquid desiccant distribution system. The evaporator 40 comprises a single distribution pad 34 in direct contact with the top edge 18 of the corresponding fins 16, and a plurality of distribution tubes 36 in fluid communication with the distribution manifold 24. The distribution tubes 36 each include a series of spray nozzles 38 disposed along the length thereof. The spray nozzles 38 are adapted to spray streams of the liquid desiccant 22 onto the top surface of the single distribution pad 34. The sprayed liquid desiccant 22 permeates throughout the pad 34 eventually flowing onto the surface of the fins 16. Since the fins 16 are closely spaced to one another, the formation of droplets under the pad 34 is eliminated.

When using the single distribution pad 34 and spray system for supplying the liquid desiccant 22, a partition 42 is mounted on top of the distribution pad 34 and enclosing the distribution tubes 36 and spray nozzles 38. The partition 42 isolates and prevents the liquid desiccant 22 sprayed from the nozzles 38 from becoming entrained in the process air stream 30.

Figure 3:
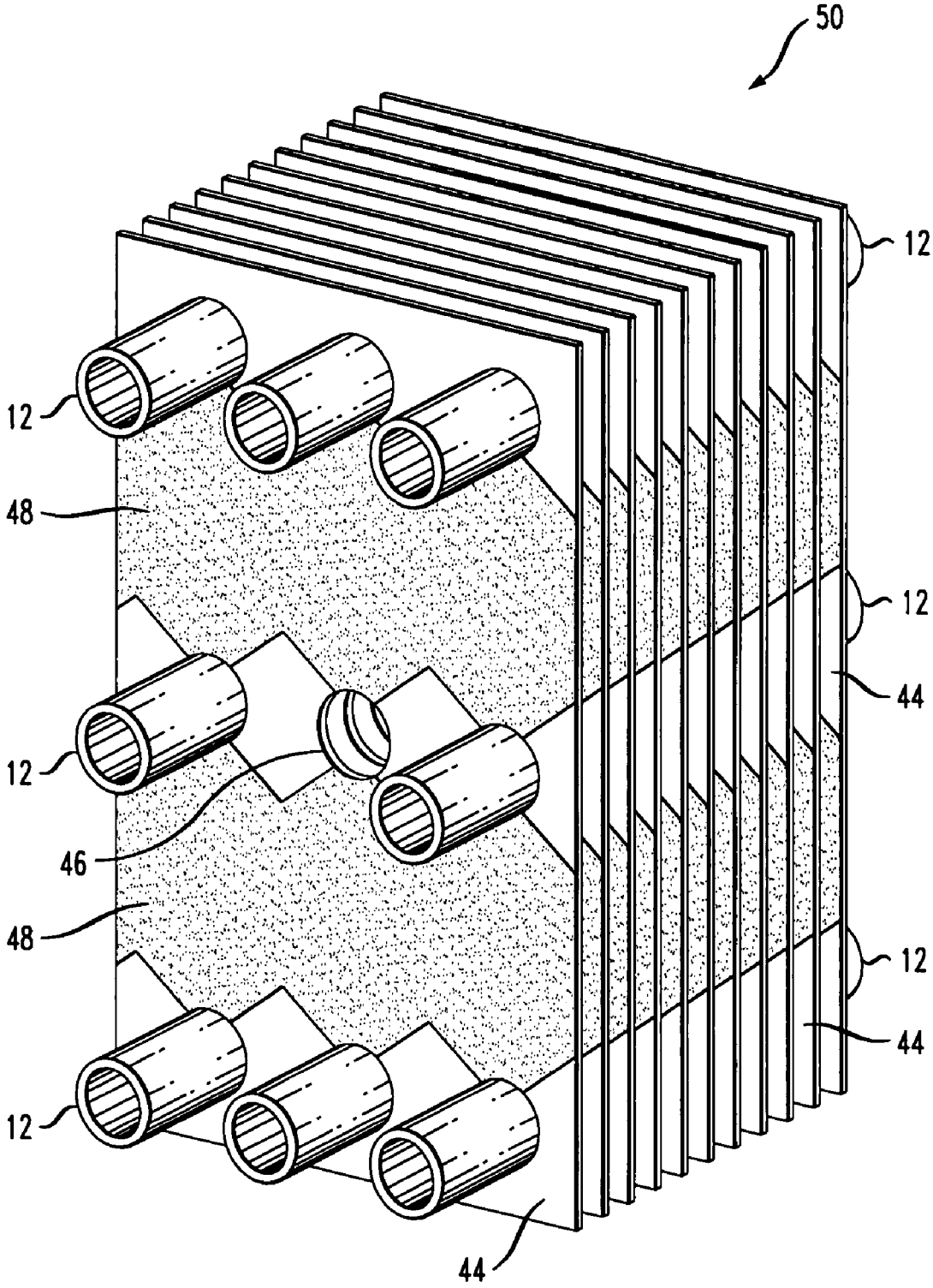
FIG. 3 is a perspective view of a heat and mass exchanger in the form of an evaporator for a third embodiment of the present invention.

Referring to FIG. 3, an evaporator 50 absent a liquid desiccant distribution assembly is shown for a third embodiment of the present invention. The evaporator 50 is similar to the evaporator 10 except for the fin configuration. The evaporator 50 includes the heat exchange tubes 12 through which the heat exchange fluid 14 flows, and a plurality of fins 44 extending contiguous from the upper rows to the lower rows of tubes 12. The fins 44 are arranged in a spaced apart configuration. Each fin 44 includes a plurality of holes 46 for receiving the tubes 12. The surface of the fins 44 is treated as described above to yield a wettable, wicking region 48 disposed between each row of tubes 12. The wicking region 48 is created to induce the liquid desiccant 22 to flow towards one of the tubes in the next row of tubes 12 during the downward flow. The surface portion of the fins 44 on either side of a tube 12 remains untreated (i.e. non-wettable, non-wicking) to deter any fluid from flowing on the fin around the tube 12. In this manner, the flow of the liquid desiccant 22 is directed onto the surface of the tube 12 during the course of the downward flow.

Figure 4:
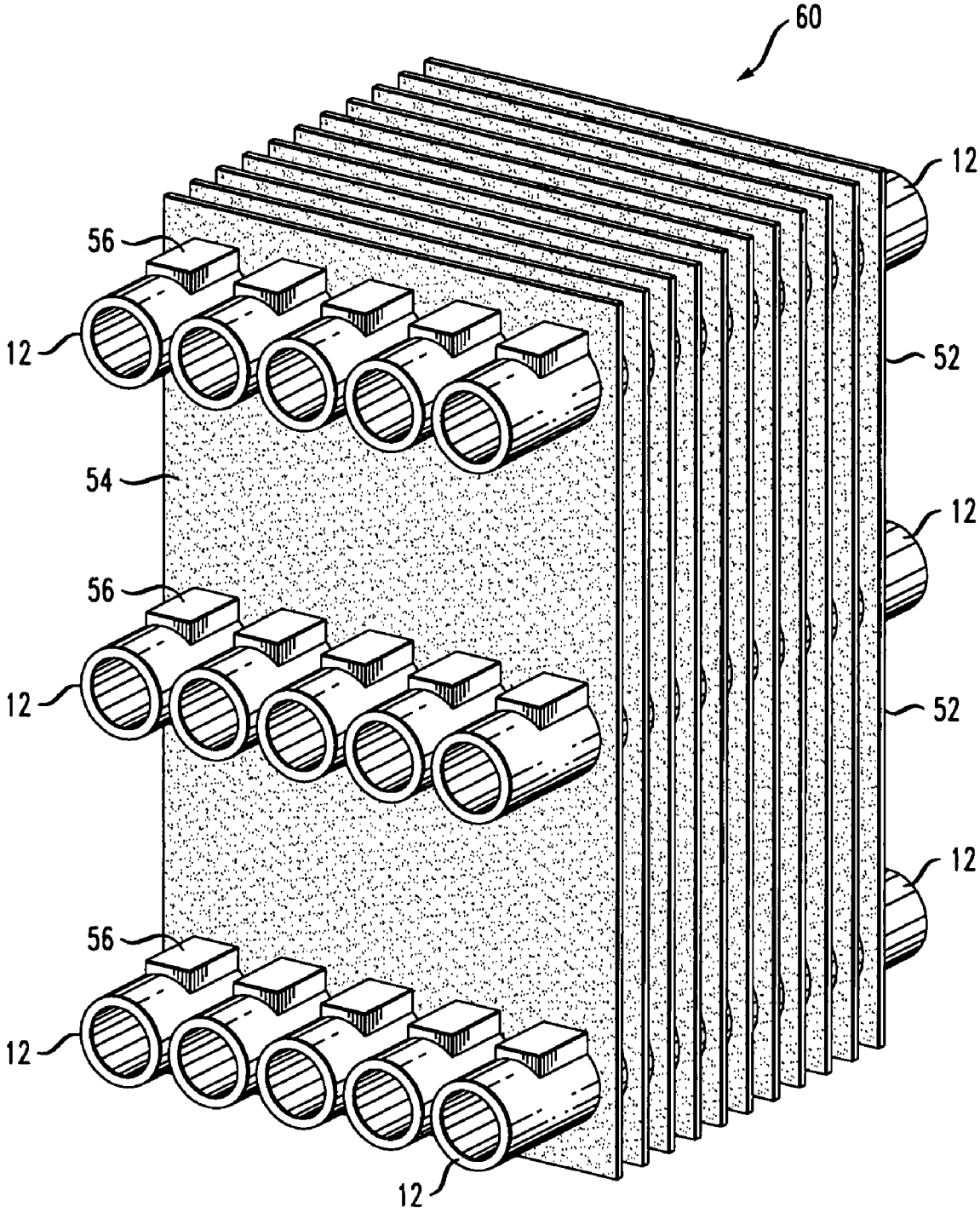
FIG. 4 is a perspective view of a heat and mass exchanger in the form of an evaporator for a fourth embodiment of the present invention.

Referring to FIG. 4, an evaporator 60 absent a liquid desiccant distribution assembly is shown for a fourth embodiment of the present invention. The evaporator 60 is similar to the evaporator 50 except for the heat exchange tube configuration. The evaporator 60 comprises a plurality of heat exchange tubes 12 in rows of five and spaced closely to one another in the same row, and a plurality of fins 52 spaced uniformly apart from one another. The entire surface of the fin 52 is treated in the manner described above to yield a wettable wicking region 54. Each tube 12 includes a wicking pad 56 disposed on the top surface thereof in contact with the wicking region 54 of the fin 52. The liquid desiccant 22 flows downward along the wicking region 54 and is drawn by the wicking pads 56 onto the tubes 12. Once drawn on top of the tubes 12, the liquid desiccant 12 flows around the tube 12 as a thin film to form a suitable thermal contact. This process is repeated at each row of tubes 12.

It is essential that the space between the fins be uniform along the length thereof. Non-uniformity of the space can induce bridging of the liquid desiccant between the adjacent fins particularly at points when the space is narrow. Bridging of the liquid desiccant creates a low resistance path for the liquid desiccant to flow from one tube to the next lower one. This creates a non-uniform flow that adversely reduces the surface area of the fin on which heat and mass exchange can occur. Bridging further creates a non-stable flow feature, where the bridges tend to break and reform. When a bridge breaks, droplets of liquid desiccant can form and be undesirably entrained into the process air stream.

Figure 5A:
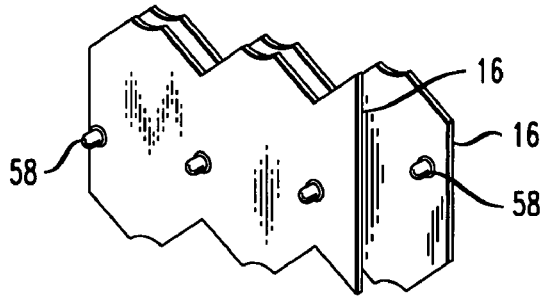
FIGS. 5A through 5D are perspective views of a pair of adjacent fins illustrating various spacer configurations in accordance with the present invention.

Referring to FIGS. 5A to 5D, there is shown four methods of maintaining a uniform space between adjacent fins 16. As shown in FIG. 5A, the fins 12 comprise small dimples 58 stamped or thermoformed onto the surface thereof. When the fins 16 are stacked, each dimple 58 comes into contact with either another dimple 58 on an adjacent fin 16 or the surface of the adjacent fin 16. Since the dimples 58 can be formed to have consistent heights, the dimples 58 provide a reliable means for maintaining uniform spaces between the fins 16.

Figure 5B:
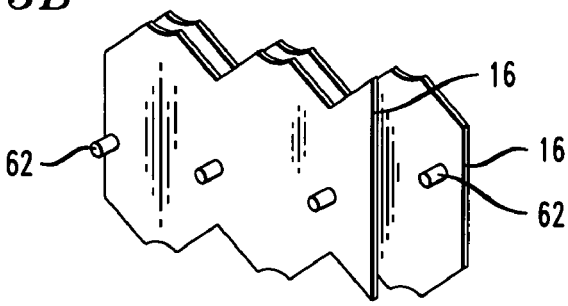

As shown in FIG. 5B, a plurality of spacers 62 are applied to the surface of the fins 16 through a suitable fastening means including, but not limited to, adhesives, welding, and bonding. The spacers 62 maintain a uniform space between adjacent fins 16. In the alternative, the spacers 62 can be formed from a bead of adhesive that spans the space between adjacent fins 16. The adhesive is initially flowable after application. The adhesive eventually cures into a hard spacer.

Figure 5C:
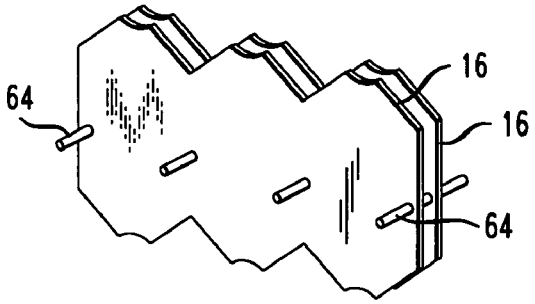

As shown in FIG. 5C, a series of spacer rods 64 are inserted through a stack of fins 16 to maintain the spaced apart arrangement. The fins 16 are either bonded to the rods 64 at the desired positions or the fins 16 are held in place by friction between the fins 16 and the rods 64. A separating means is preferable to maintain the fins 16 in a spaced apart arrangement during insertion of the spacer rods 64.

Figure 5D:
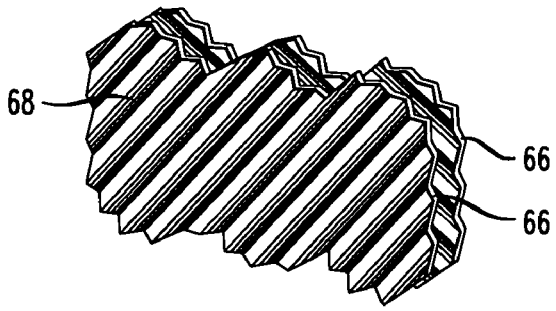

As shown in FIG. 5D, a pair of fins 66 include corrugations 68 formed thereon. The fins 66 are placed adjacent to one another and are maintained in a spaced apart arrangement by the corrugations 68. As previously indicated the fins as shown in FIGS. 5A-5D may be planar, bowed, corrugated or the like.

Figure 6:
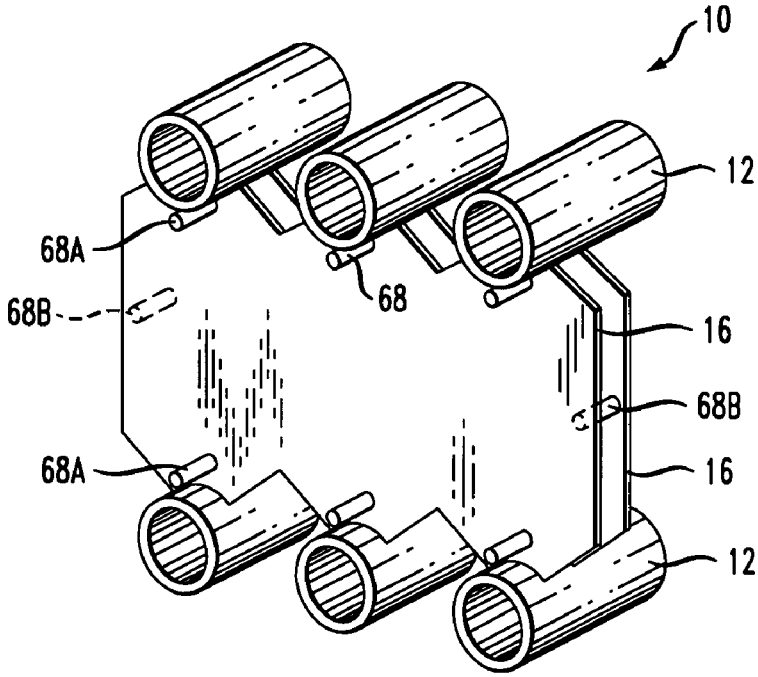
FIG. 6 is a perspective view of a portion of the evaporator of FIG. 1 in combination with a spacer configuration in accordance with the present invention.

Referring to FIG. 6, a portion of the evaporator 10 of FIG. 1 is shown. The evaporator 10 includes a plurality of spacers 68A, 68B. Typically, the liquid desiccant 22 tends to thicken under a spacer. This can cause bridging between adjacent fins 16. The spacers 68A are positioned on the fin 16 in close proximity to a corresponding tube 12 where bridging does not cause problems. The spacers 68B are positioned in an area where the liquid desiccant flow will be low and so there is less tendency for the liquid desiccant 22 to bridge between adjacent fins 16.

It is essential that the surface of the heat exchange tube is readily wettable by the liquid desiccant. If the tube is not readily wettable, there is a tendency for discrete rivulets to form on the surface of the tube. The presence of rivulets indicates that only a portion of the surface of the tube is exchanging heat with the liquid desiccant 22.

However, even if the entire surface of the tube is wetted with the liquid desiccant 22, it has been observed that the film thickness of the liquid desiccant that flows around the tube may result in a non-uniform film thickness. This non-uniformity can also reduce the heat exchange between the liquid desiccant and the tube. It may also be desirable for the surface of the tube to be wicking to insure that the flow of the liquid desiccant 22 on the surface of the tube has a relatively uniform thickness. However, the use of a wick on the surface of the tube must be used with discretion since the wick itself can interfere with the flow of heat between the liquid desiccant 22 and the tube if it is too thick.

Wicks that can be used on the tubes of the evaporator are similar to those that have been described for the fins. Applicants have successfully used fibers of glass, carbon, acrylic, polyester and nylon as wicking material that can be adhered to the surface of the tube. In all instances the thickness of the wicking material in the form of a fiber layer ranges from about 10 mils to 25 mils.

Figure 7:
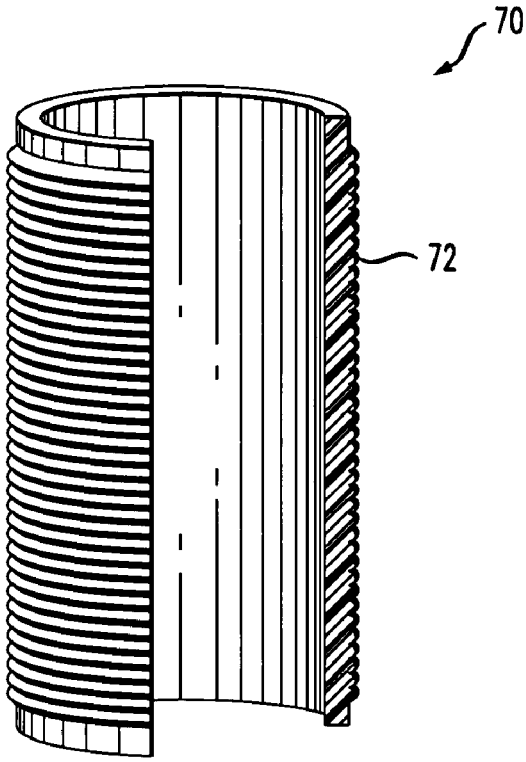
FIG. 7 is a partial cutaway perspective view of a heat exchange tube illustrating one surface design in accordance with the present invention.

Referring to FIG. 7, a portion of a heat exchange tube 70 is shown for one embodiment of the present invention. It is important to provide a sufficient thermal contact between the liquid desiccant 22 and the heat exchange tube 70. The tube 70 includes a plurality of circumferential grooves 72 extending along the length thereof. The grooves 72 may also form a helix. The grooves 72 substantially increase the area for heat transfer between the tube 70 and the liquid desiccant 22. The grooves 72 also reduce the formation of discrete rivulets from the liquid desiccant 22 that would otherwise form. The formation of rivulets adversely reduces the surface area on which heat is exchanged with the liquid desiccant.

In one embodiment that was tested, the grooves 72 have a pitch of 40 per inch and a peak-to-trough height of 0.020 inch. Applicants have observed a 300% increase in the heat transfer coefficient between the tube 70 and the liquid desiccant 22 when the tubes have grooves as described above.

Figure 8:
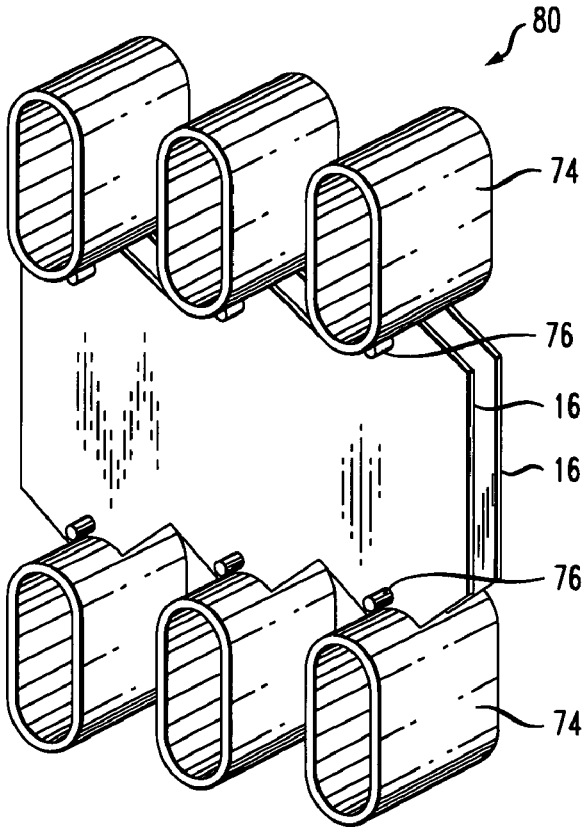
FIG. 8 is a perspective view of a portion of an evaporator with multiple heat exchange tubes having elongated cross sections shown in combination with a spacer configuration in accordance with the present invention.

Referring to FIG. 8, there is shown a portion of an evaporator 80 with multiple heat exchange tubes 74 having oblong cross sections shown in combination with a plurality of spacers 76. The spacers 76 are each disposed on the surface of the fins 16 proximate the heat exchange tubes 74. The tubes 74 exhibit a flattened cross section which increases the surface area on which the liquid desiccant 22 exchanges heat. Furthermore, the substantially vertically oriented surface of the tube 74 increases the velocity of the flow of the liquid desiccant, thus reducing the thickness of the liquid desiccant 22 flowing over the tube surface, and enhancing the transfer of heat. Alternatively, the tubes 74 may be modified with an oval cross section to yield similar enhanced heat transfer efficiency.

Figure 9:
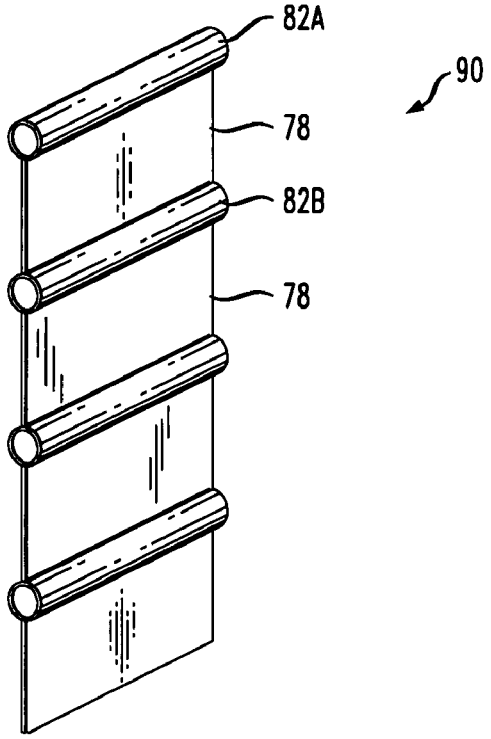
FIG. 9 is a perspective view of an evaporator with multiple heat exchange tubes in combination with a plurality of fins each disposed between the corresponding tubes in accordance with the present invention.

Referring to FIG. 9, an evaporator 90 is shown without a liquid desiccant distribution system for an alternate embodiment of the present invention. The evaporator 90 includes a plurality of fins 78 each disposed between adjacent heat exchange tubes 82. The fins 78 each extend from one tube (e.g. 82A) to the lower adjacent tube (e.g. 82B), and they lie in a plane defined by the axes of the tubes. The liquid desiccant that flows down the surface of a fin 78 must flow around and exchange heat with a tube 82 before it can continue flowing down on the next lower fin 78. This arrangement ensures that the entire surface of the tube 82 exchanges heat with the liquid desiccant flowing down the fin 78. This embodiment may benefit from the use of tubes 82 with a flattened or elongated cross section and a tube surface that is grooved or lined with a wicking material.

Figure 10A:
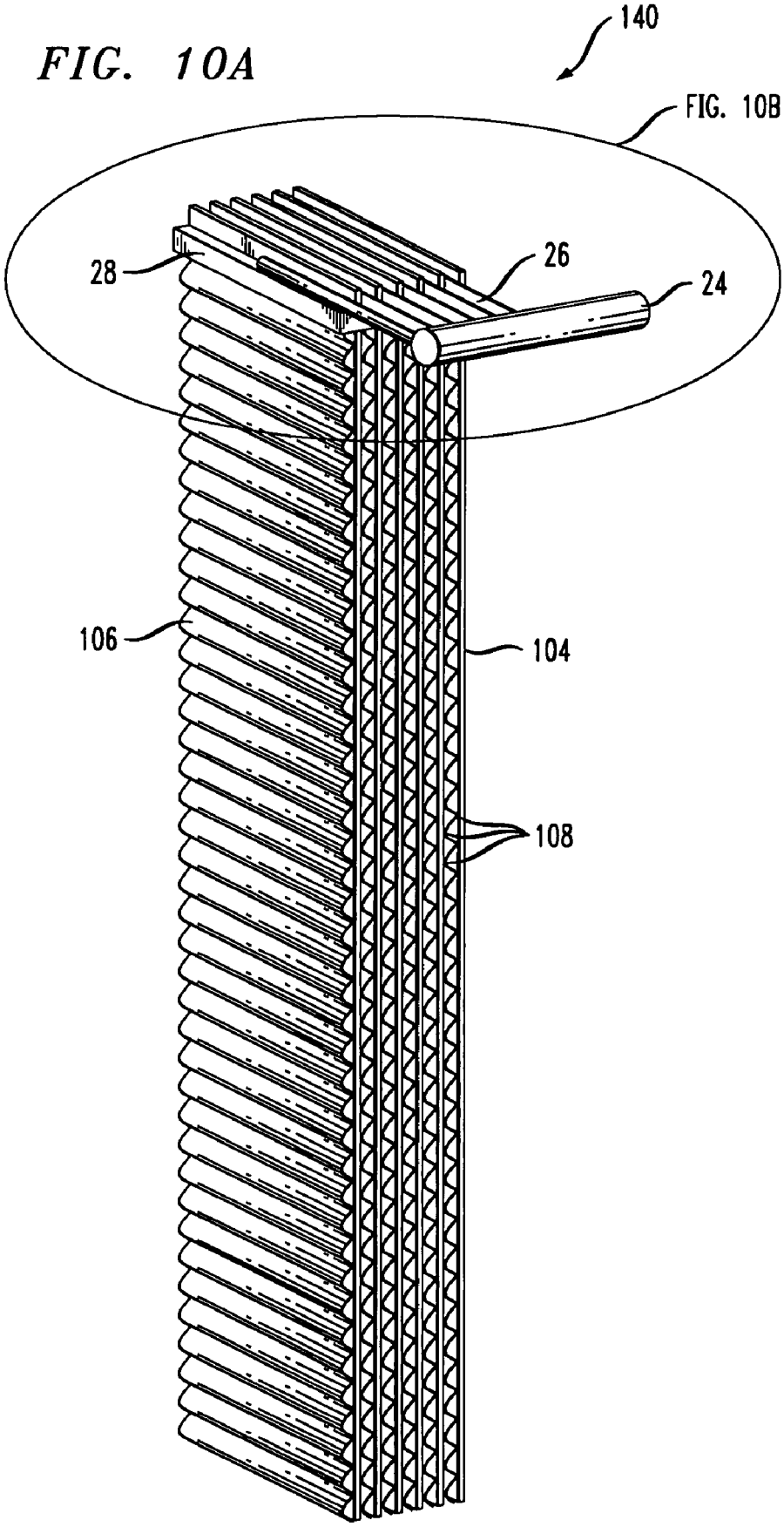
FIG. 10A is a perspective view of an evaporator comprising an array of vertical plates and a corrugated fin disposed between adjacent plates for another embodiment of the present invention.
Figure 10B:
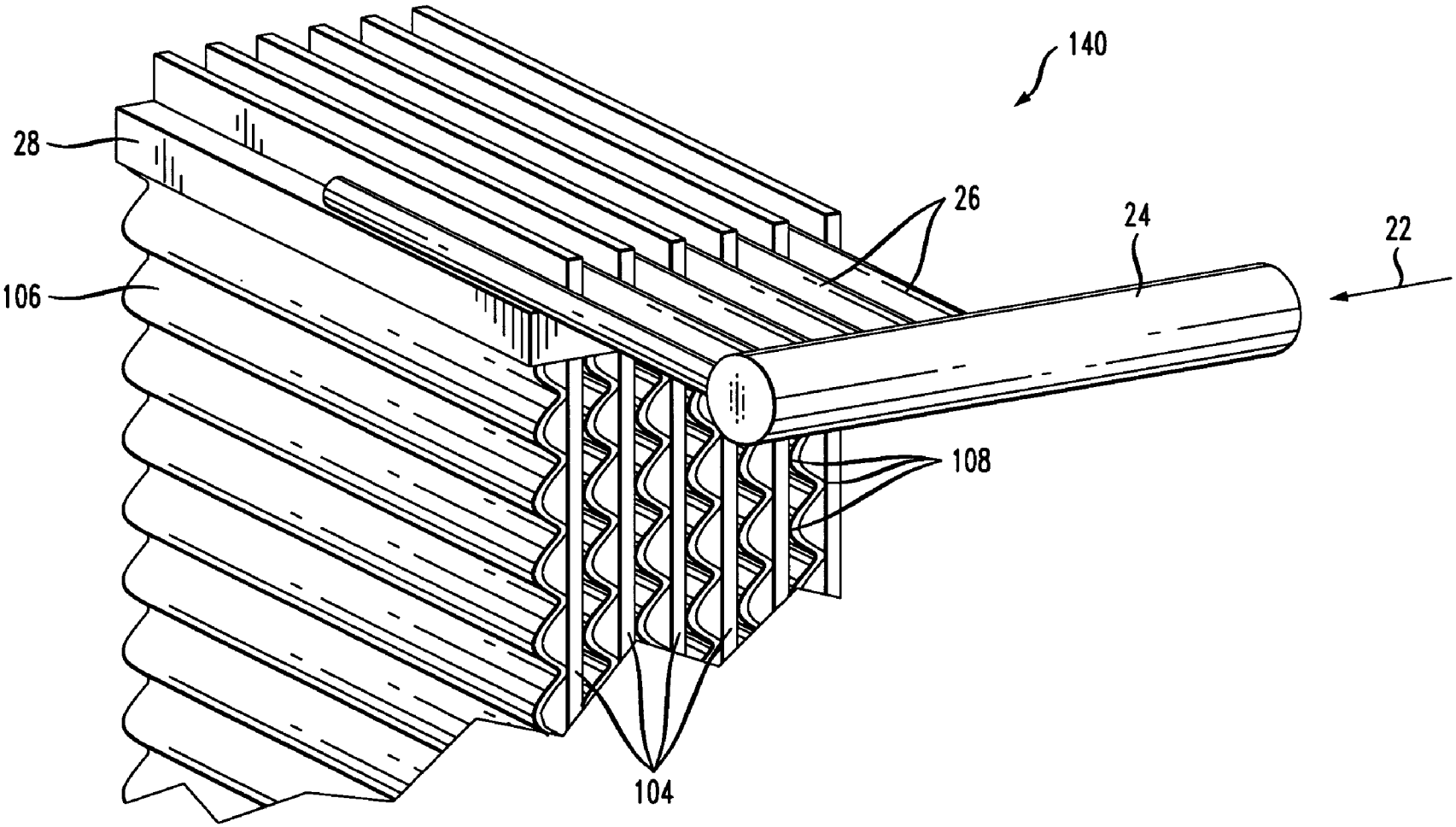
FIG. 10B is an enlarged view of the portion marked FIG. 10B of FIG. 10A in accordance with the present invention.

Referring to FIGS. 10A and 10B, an evaporator 140 is shown for another embodiment of the present invention. The evaporator 140 includes a plurality of vertical heat exchange plates 104 arranged in a spaced apart configuration, and a plurality of corrugated fins 106 each disposed between corresponding adjacent plates 104. The evaporator further includes a distribution manifold 24 for delivering a liquid desiccant from a regenerator (not shown), and a plurality of distribution tubes 26 for distributing the liquid desiccant from the distribution manifold 24 to a plurality of distribution pads 28 each positioned between adjacent plates 104. The liquid desiccant 22 disperses throughout the pad 28 and uniformly flows down the surface of the plates 104. The liquid desiccant 22 is eventually collected in a reservoir (not shown) and returned to the regenerator (not shown) for reprocessing.

The exterior portion of the plates 104 and the corrugated fins 106 are treated to yield a wettable, wicking surface in the manner described above. The wicking surface of the plates 104 facilitates a uniform flow of liquid desiccant 22. The corrugated fins 106 are disposed in close proximity or in contact with the corresponding adjacent plates 104 at discrete contact locations 108. The contact locations 108 allows the liquid desiccant 22 flowing down the plate 104 to continue the flow on the surface of the plate 104 or move onto the surface of the corrugated fin 106.

The corrugated fins 106 are preferably composed of a wettable, wicking material which provide a wicking surface on the fin 106 so that the liquid desiccant 22 is able to flow uniformly. Suitable forms of the fins include screens, meshes, or non-woven sheets made from plastic, metal, carbon, glass, ceramic or cellulose fibers, and thin films that have a grit or fiber composed materials such as plastic, metal, carbon, glass, ceramic, mineral or cellulose adhering to the surface of the fin 106.

The heat exchange plate 104 includes a heat exchange fluid flowing internally to facilitate heat transfer with the liquid desiccant 22. It may be desirable for the heat exchange fluid flowing internally within the plate 104 to make multiple passes therein as will be described hereinafter. Details of such heat exchange plates are further disclosed in U.S. Pat. No. 6,079,481, the content of which is incorporated herein by reference. A process air stream is passed through the space between the fins 106 and the plates 104 where the stream is cooled and dried by contact with the liquid desiccant 22 flowing down the fins 106 and the plates 104.

Figure 11:
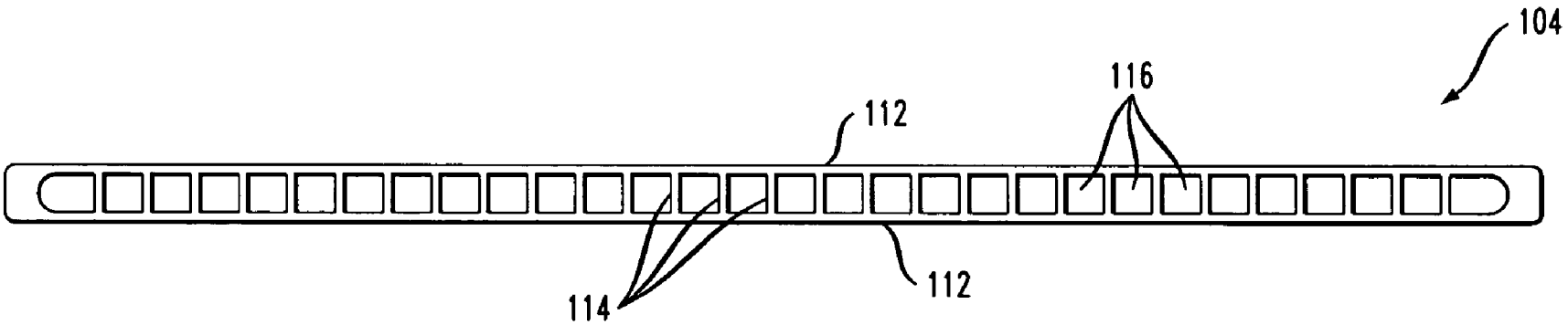
FIG. 11 is a transverse cross sectional view of a heat exchange plate showing internal channels separated by internal webs for use in the present invention.

Referring to FIG. 11, a cross section of a heat exchange plate 104 is shown. The plate 104 comprises a pair of plate walls 112 maintained uniformly spaced apart by a plurality of spaced apart webs 114. The webs 114 define a plurality of fluid carrying channels 116 for conveying the heat exchange fluid therethrough.

Figure 12:
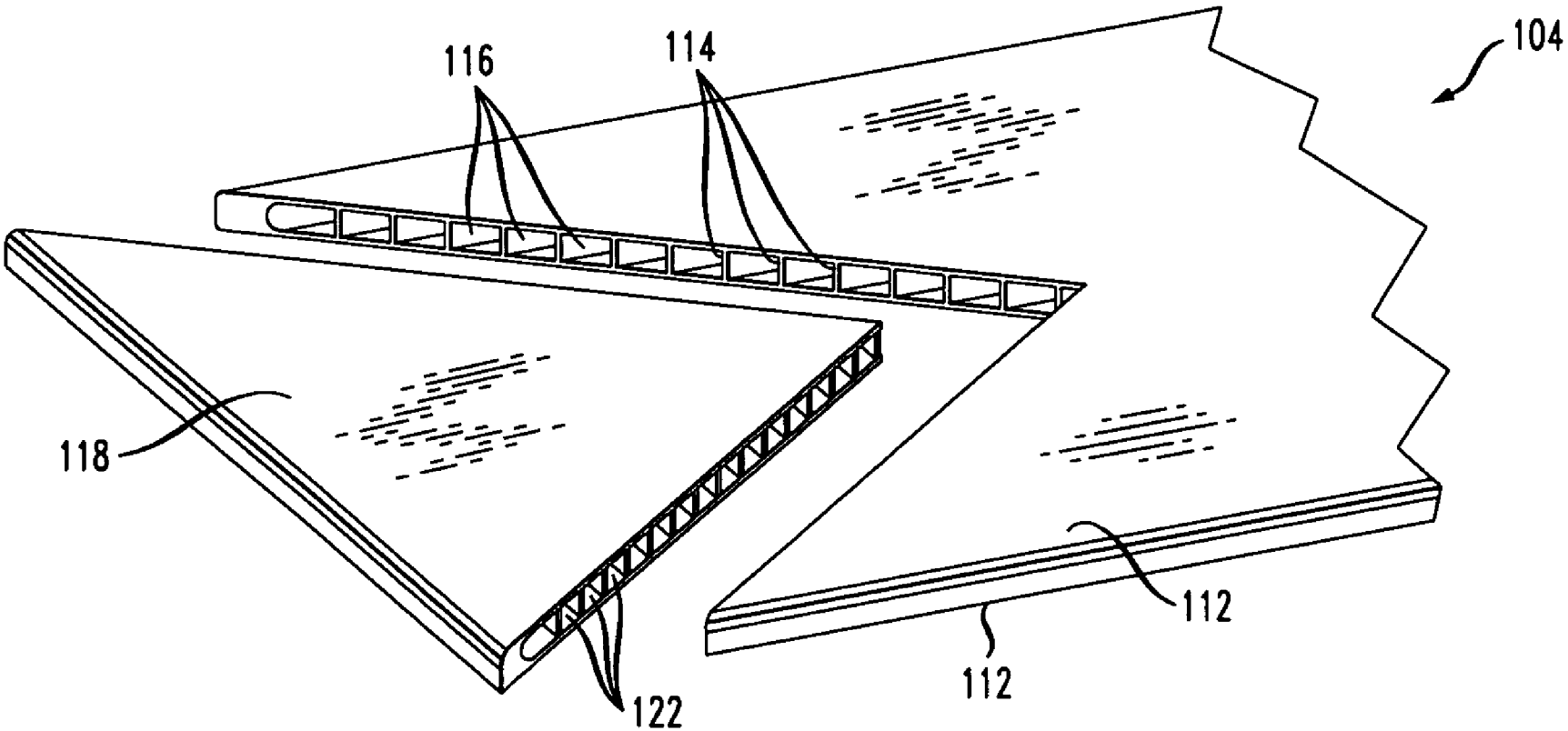
FIG. 12 is a perspective view of a triangular insert coupled to a heat exchange plate to yield a two-pass flow circuit within the plate for use with the present invention.

Referring to FIG. 12, the heat exchange plate 104 includes a triangular insert 118 comprising a plurality of channels 122 extending transversely therethrough. The channels 122 of the insert 118 are oriented in a manner that when the insert 118 is coupled to the plate 104, the channels 122 fluidly connect channels 116 of one side of the plate 104 to channels 116 of the other side of the plate 104 to yield a two-pass fluid circuit. The heat exchange fluid enters the plate 104 through channels 116 in one side and enters the channels 122 of the insert 118 and undergoes a 180-degree turn into the channels 116 in the other side of the plate 104. The turning of the heat exchange fluid is executed within the plane of the plate 104 without using an external manifold or additional fittings attached to the plate 104.

Figure 13A:
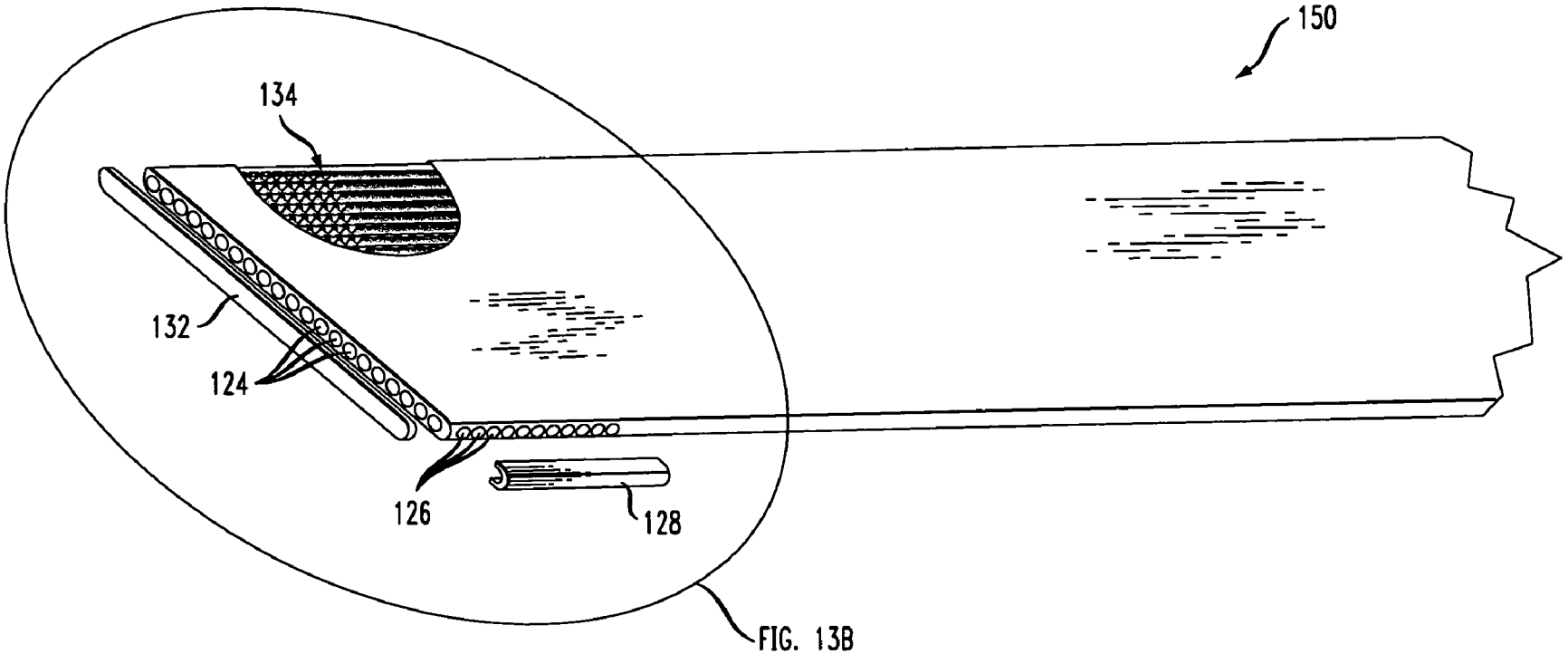
FIG. 13A is a partial cutaway perspective view of a heat exchange plate having a series of holes bored through a sidewall portion intersecting the internal channels to yield a two-pass flow circuit within the plate in accordance with the present invention.
Figure 13B:
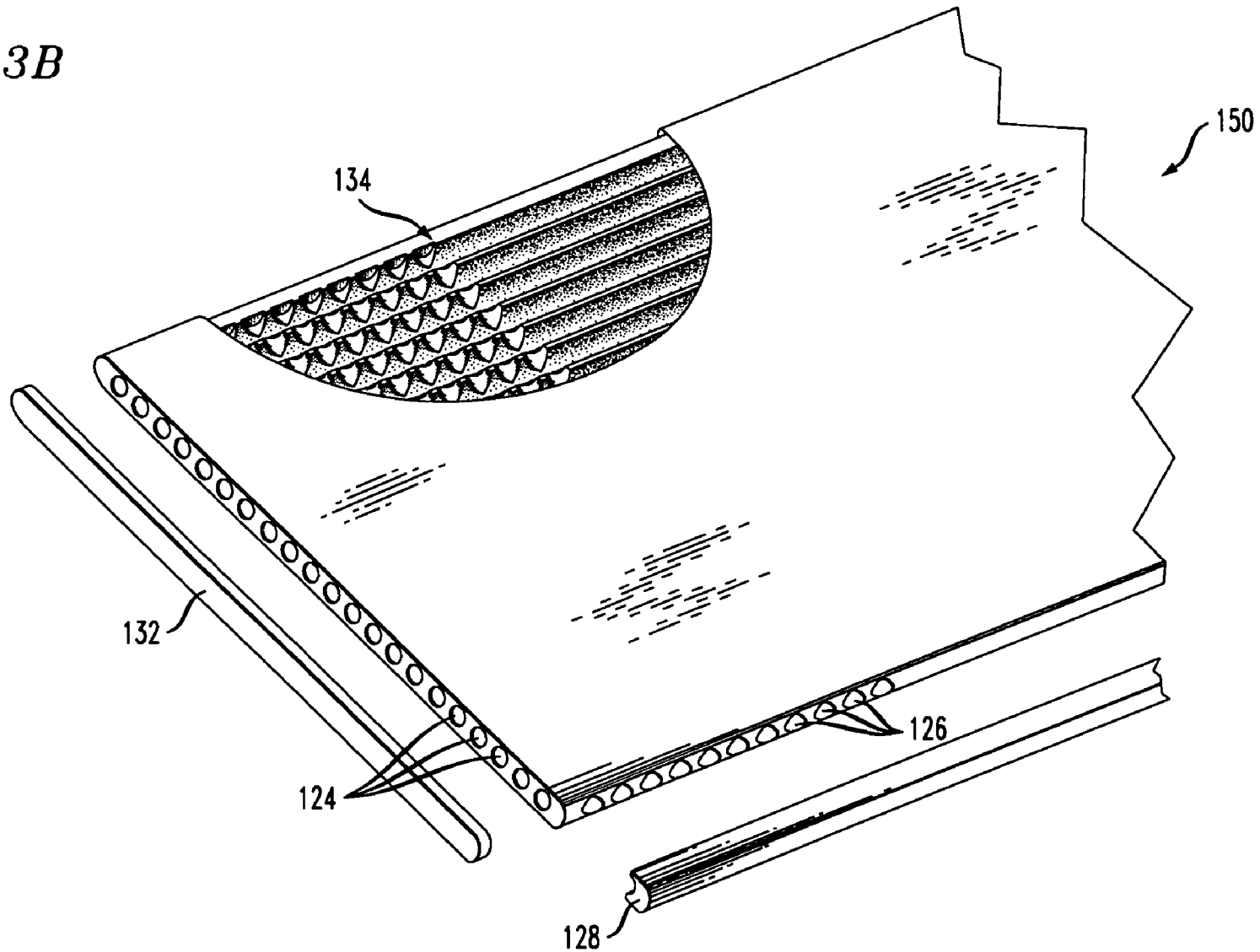
FIG. 13B is an enlarged view of the portion marked FIG. 13B of FIG. 13A in accordance with the present invention.

Referring to FIGS. 13A and 13B, a heat exchange plate 150 is shown for another embodiment of the present invention. The heat exchange plate 150 is similar to the heat exchange plate 104. The heat exchange plate 150 comprises a plurality of fluid conveying channels 124 extending longitudinally therein, and a plurality of bores 126 extending perpendicularly to and intersecting the channels 124 at one end of the plate 150. The intersecting channels 124 and bores 126 form an fluid turning area 134 that permits fluid passing through the channels 124 to turn 180-degrees, thus yielding a two-pass or multiple-pass fluid circuit. A side cover member 128 is attached to the plate 150 to maintain the bores 126 fluidly sealed from the outside. An end cover member 132 is attached to the plate 150 to maintain the channels 124 fluidly seal from the outside.

Figure 14:
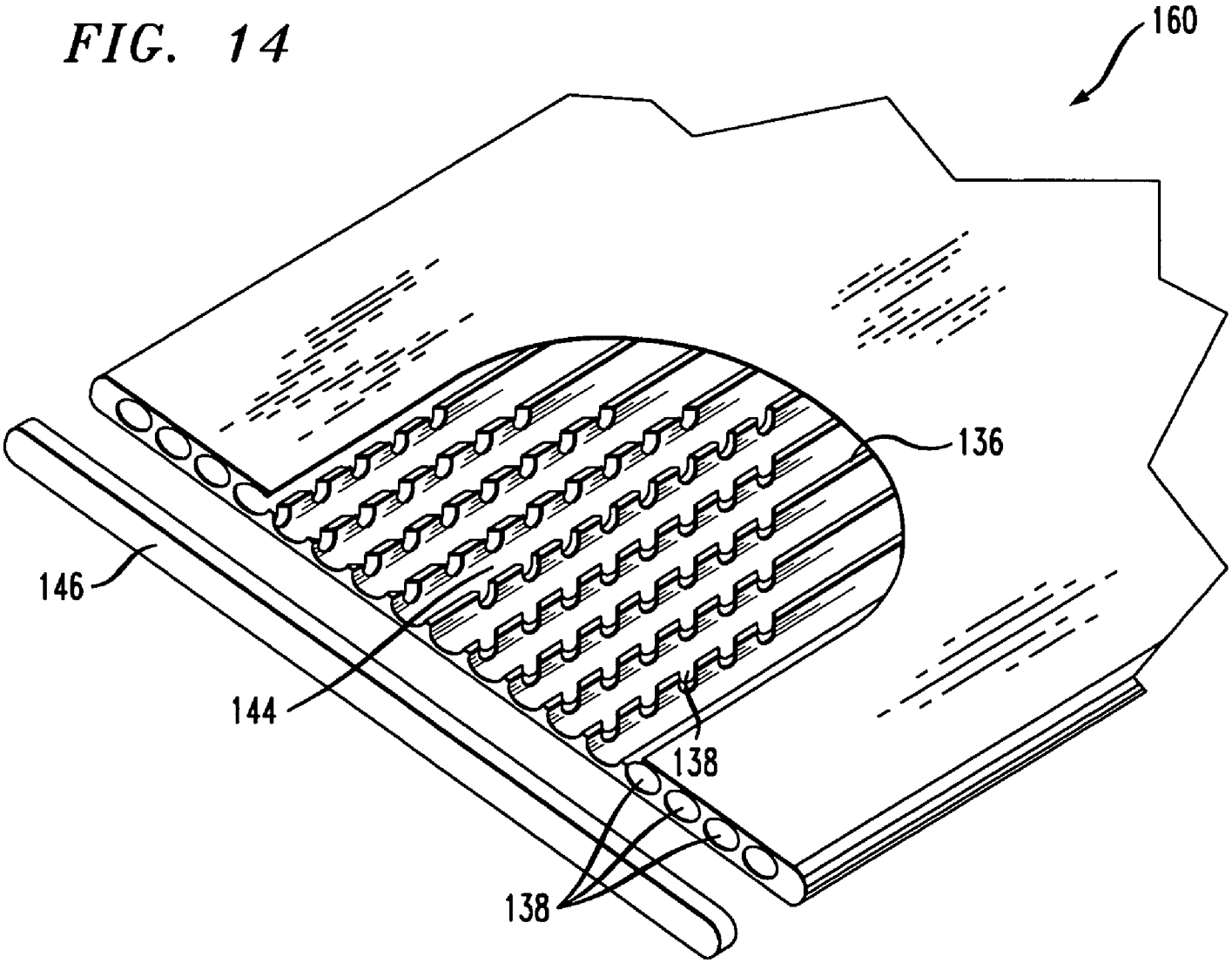
FIG. 14 is a partial cutaway perspective view of a heat exchange plate having a series of holes bored at an angle intersecting the internal channels to yield a two-pass flow circuit within the plate in accordance with the present invention.

Referring to FIG. 14, a heat exchange plate 160 is shown for another embodiment of the present invention. The heat exchange plate 160 is similar to the heat exchange plate 150 except for the absence of the side cover member. The heat exchange plate 160 comprises a plurality of channels 136 extending longitudinally therein and in communication with a plurality of bores 138 extending within the plate 160 and intersecting the channels 136 at an angle. The intersecting channels 136 and bores 138 form an fluid turning area 144 that permits fluid passing through the channels 136 to turn 180-degrees, thus yielding a two-pass or multiple-pass fluid circuit. The bores 138 do not intersect the sidewall of the heat exchange plate 180. An end cover member 146 is attached to the plate 150 to maintain the channels 136 and bores 138 fluidly seal from the outside. Alternatively, the open end of the plate 160 may be sealed by suitable means including welding or plugging with an adhesive.

Figure 15:
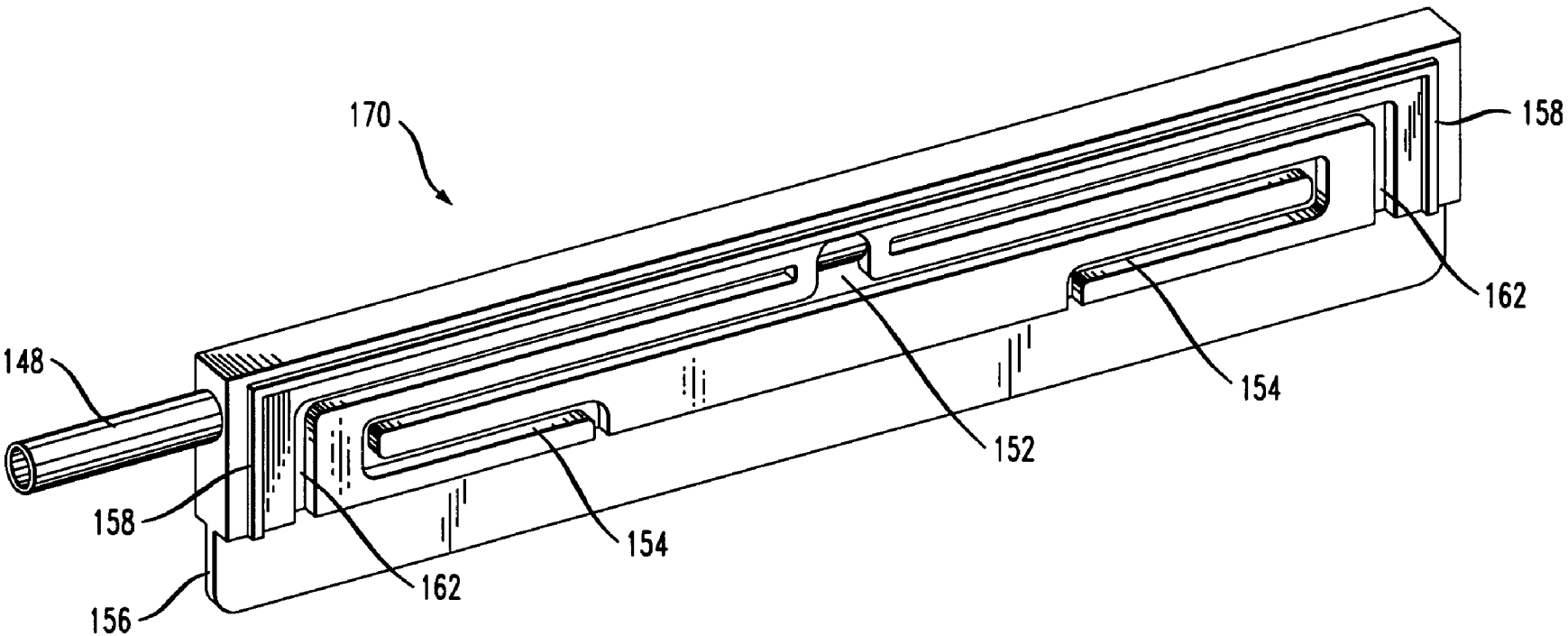
FIG. 15 is a perspective view of a distribution insert for delivering a liquid desiccant to a corresponding pair of heat exchange plates in accordance with the present invention.

Referring to FIG. 15, a distribution insert 170 is shown for one embodiment of the present invention. The distribution insert 170 can be utilized to replace the distribution pads 28 of FIG. 11 to deliver the liquid desiccant 22 to the top end of the plate 104 of the evaporator 140. Each distribution insert 170 is adapted to receive and accommodate the top end portions of adjacently positioned heat exchange plates 104.

Liquid desiccant is delivered to the distribution insert 170 from the distribution manifold 24 and the distribution tube 26 to a small diameter inlet 148. The structural elements of one side of the distribution insert 170 are the same on the other side. The small diameter inlet 148 is in fluid communication with a throughhole 152 extending perpendicularly with the face portions of the distribution insert 170. The distribution insert 170 further includes a delivery groove 154 disposed on each side thereof to deliver the liquid desiccant from the throughhole 152 to the top portions of the adjacent pair of the heat exchange plates 104 that are positioned on each side thereof.

In order in ensure that substantially equal amount of liquid desiccant is delivered to each plate 104, the resistance to the flow in the distribution manifold 24 is small compared to the resistance in the flow path in the distribution insert 170 to the surface of each plate 104. The flow resistance may be increased through reducing the width and depth of the grooves 154. However, the width and depth should be sufficiently large to avoid blockages by either scale or solid particles that may be deposited on the inner surfaces of the flow path. Alternatively, the flow length of the grooves 154 may be lengthened to increase flow resistance, while preventing flow blockages.

Applicants have observed that streams of liquid desiccant that flow from the distribution insert 170 onto the opposed sides of the plates 104 can combine to bridge the gap across adjacent plates 104. This can cause the process air stream to interact with the bridge of liquid desiccant and strip away droplets.

To minimize such occurrences, the distribution insert 170 further includes a thinner skirt 156 extending along the lower edge thereof. The skirt 156 effectively prevents bridging between the liquid desiccant flows on the opposed surfaces of the plates 104.

The distribution insert 170 further includes a raised sealing barrier 158 and a secondary drain groove 162 that directs liquid desiccant onto the surface of the plates 104 that may leak from the sides of the deliver groove 154.

EXAMPLE

In this example, a mass and heat exchanger that is designed according to the principles taught herein is installed in a vapor-compression air conditioner to replace a conventional evaporator. The replaced conventional evaporator is an industry-standard finned-tube heat exchanger with copper tubes and aluminum fins. The conventional evaporator possesses the following characteristics:

| | |
|---|---|
| Total number of tubes | 92 |
| Number of tubes in vertical column | 23 |
| Number of tube columns | 4 |
| Tube outer diameter | 0.3325 in |
| Fin orientation | vertical and perpendicular to tubes |
| Fin height | 24.0 in |
| Fin width | 2.5 in |
| Fin thickness | 0.010 in |
| Fin spacing | 13 fins per inch |
| Volume of air processed | 1000 cfm |
| Face velocity for incoming air | 263 fpm |

With R-22 refrigerant evaporating at a saturation temperature of 49° F. within the tubes of this heat exchanger and 1000 CFM of air entering at 80° F. dry-bulb temperature and 67° F. wet-bulb temperature flowing over the outside of the fins and tubes, the conventional heat exchanger absorbs 30,100 Btu per hour from the air and remove 8.6 lbs per hour of water.

The conventional evaporator is replaced with a mass and heat exchanger in the form of an evaporator that is designed according to the principles taught herein. A 37% (by weight) solution of lithium chloride, a strong liquid desiccant, is applied as a flow on the outside of the mass and heat exchanger. To facilitate a useful comparison of the conventional evaporator and the present invention, the mass and heat exchanger is designed to match the above listed characteristics of the conventional evaporator particularly with regard to (1) total number of tubes (approximately), (2) tube outer diameter, (3) volume of air processed, (4) face velocity for incoming air, and (5) the temperature of the evaporating refrigerant within the tubes.

The tubes, oriented horizontally, are arranged in a square array of five per row and eighteen per column. (The process air stream is generated to flow in the direction of the rows and the liquid desiccant is delivered to flow in the direction of the columns.) The five tubes in each row are aligned with a ¼ inch gap between adjacent tubes. The 18 tubes in each column are also aligned with a one inch gap between them. The tubes include helical saw-tooth grooves on the outer surface. There are 40 grooves per inch, and each groove has a 20 mil trough-to-peak dimension.

The tubes are fabricated from either copper or a 90/10 copper-nickel alloy. If copper tubes are used, a corrosion inhibitor such as LIMIT 301, which is manufactured by FMC Lithium of Gastonia, N.C., is added to the lithium-chloride solution. (FMC reports that the corrosion rate of copper in lithium chloride with LIMIT 301 at 100° F. is 2.0 mils per year. This corrosion rate is significantly lower at the 50° F. operating temperature of this example.)

Thin, wicking fins are inserted in the one inch gap between tube rows and perpendicular to the tubes. The fins are made from a PVC film with a thickness of 10 mils. Each fin is prepared with acrylic fibers adhesively applied on both sides thereof. The fibers are 20 mils long and 3 denier. (The "denier" is the standard measure of fiber diameter.) The fins are 3 inches by 1 inch, and stacked to yield seven fins per inch.

A total of 630 ml per minute of desiccant is pumped to open-cell melamine foam pads that sit on top of the tubes in the uppermost row. The liquid desiccant is first filtered before delivery to the pads. From the pads, the desiccant flows by gravity onto all 18 rows of tubes and fins, flowing off of the lowermost row of fins into a collection sump. In traveling from the foam pad to the collection sump, the desiccant does not traverse any air gaps that may cause it to breakup into droplets.

The performance of the liquid-desiccant mass and heat exchanger is modeled by separately calculating the heat transfer between the tubes and the desiccant films that flow around the tubes, and the heat and mass transfer between the process air stream and the liquid desiccant films that flow on the fins. The heat transfer between the tubes and the desiccant films is calculated assuming that U, the heat transfer coefficient is 500 Btu/h-ft2-F. Values of U between 520 and 680 Btu/h-ft2-F have been measured in bench-top experiments. Since a higher value of U will lead to a more compact and efficient mass and heat exchanger, the assumption that U is 500 Btu/h-ft2-F is conservative. Knowing the temperature of the liquid desiccant that flows onto the tube, the surface area available for heat transfer, the heat transfer coefficient U, the temperature within the tubes (i.e., the temperature of the evaporating refrigerant), the flow rate of desiccant, and the heat capacity of the desiccant, one can calculate from the conservation of energy the temperature of the desiccant as it flows off of the tube onto the fins.

The fins form parallel-wall channels for the flow of the process air stream. For the design studied here the velocity of the air in these channels is 525 fpm. The Reynolds number for this air flow is about 900, which means that the air flow will be laminar. Heat and mass transfer coefficients for laminar flows between parallel walls are well known as functions of Reynolds number and Prandtl number (which will be 0.7 for air). Using these heat and mass transfer coefficients and the properties for the liquid desiccant, the exchange of heat and mass between the air and the desiccant films is calculated. With these exchanges known, the temperature and humidity of the air that leaves the channels between the fins are calculated and the temperature and concentration of the liquid desiccant leaving the fins and flowing onto the next row of tubes are calculated.

The preceding calculational procedure is repeated for each row of tubes and fins.

The completed performance calculation shows that for the desiccant flow rate and the fin height that has been selected, the temperature of the desiccant increases 10° F. while it is absorbing water vapor on the fin. This change in temperature produces an acceptable 10% decrease in the driving potential for water absorption. Also, after passing over all the fins and tubes the desiccant's concentration decreases to 34.7% from its initial value of 37.0%. This 2.3 point change in concentration produces an acceptable 4.0% decrease in the driving potential for water absorption.

The complete performance calculation shows that the liquid-desiccant mass and heat exchanger absorbed 31,100 Btu per hour of heat and 17.4 lbs per hour of water from the air. This heat absorption is almost 4% higher than the conventional evaporator and the water removal is more than 2 times higher. The increased water removal is very important in HVAC applications where humidity control is critical, and provides a strong incentive for air conditioners to replace their conventional evaporator with a liquid-desiccant mass and heat exchanger of the present invention.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A heat and mass exchanger for exchanging heat and mass between a gas and a liquid comprising:

a plurality of substantially parallel tubes arranged in spaced apart relationship including at least one upper tube which is above and spaced apart from at least one lower tube, said tubes having an outer surface;

spaced apart fins each having respective top and bottom edge portions positioned in a space between adjacent upper and lower tubes, wherein the top edge portion is proximate to the upper tube and the bottom edge portion is proximate to the lower tube, said spaced apart fins being oriented at least substantially perpendicular to the longitudinal axis of the tubes and comprising at least one surface in contact with the gas;

said at least one surface of the spaced apart fins adapted to provide at least one pathway for the liquid to flow by gravity in a continuous flow covering substantially the entire surface thereof from the upper to the lower tubes without forming droplets, and to channel at least a substantial portion of the liquid to flow onto the outer surface of the plurality of substantially parallel tubes;

a liquid supply assembly for delivering the liquid in a continuous flow to the tubes and fins; and means for internally heating or cooling at least some of the tubes.

2. The heat and mass exchanger of claim 1 comprising at least two rows of spaced apart tubes with each row containing a plurality of tubes.

3. The heat and mass exchanger of claim 1 wherein the outer surface of the tubes comprise heat-transfer enhancing means for enhancing heat transfer between the tubes and the liquid.

4. The heat and mass exchanger of claim 3 wherein the heat-transfer enhancing means comprises grooves oriented circumferentilly or helically around the outer surface of the tube.

5. The heat and mass exchanger of claim 1 wherein the tubes have a circular cross section.

6. The heat and mass exchanger of claim 1 wherein the tubes have an elongated cross-section with a major axis of the cross-section in a vertical orientation.

7. The heat and mass exchanger of claim 1 wherein at least one surface comprises wicking means enabling the fins to wick the liquid.

8. The heat and mass exchanger of claim 1 wherein said spaced apart fins have opposed contoured edge portions contoured to match the curvature of the tubes to enable the fins to be securely seated therein and to facilitate the flow of the liquid from the fins to the tube.

9. The heat and mass exchanger of claim 8 wherein the opposed contoured edge portions comprise drip preventing means.

10. The heat and mass exchanger of claim 1 wherein the at least one spaced apart fin comprises both liquid wettable and non-wettable regions configured to direct the liquid toward the outer surface of at least one of the lower tubes.

11. The heat and mass exchanger of claim 1 wherein the spaced apart fins have a flat or bowed shape.

12. The heat and mass exchanger of claim 1 wherein the spaced apart fins are made from a material having a thermal conductivity of less than 10W/m-C.

13. The heat and mass exchange of claim 1 wherein the spaced apart fins comprise a thin film of plastic material having a thickness of less than 15 mils, and a wicking region located on the surface of each fin.

14. The heat and mass exchanger of claim 1 further comprising spacer means to maintain the spaced apart fins in spaced apart relationship.

15. The heat and mass exchanger of claim 1 wherein the spaced apart fins comprise corrugated sheets.

16. The heat and mass exchanger of claim 1 wherein the liquid supply assembly comprises a source of liquid, at least one conduit for delivering the liquid from the source to a distribution manifold and at least one substrate operatively engaged to the upper tube for receiving the liquid from the distribution manifold and delivering the same to the outer surface of the upper tubes.

17. The heat and mass exchanger of claim 1 wherein the liquid is a liquid desiccant.

18. The heat and mass exchanger of claim 1 wherein the means for internally heating or cooling the tubes is a condensing vapor or an evaporating liquid.

19. The heat and mass exchanger of claim 1 comprising at least two rows of substantially parallel tubes with a plurality of spaced apart fins positioned between the two rows.

20. The heat and mass exchanger of claim 19 comprising at least three rows of substantially parallel tubes with separate sets of spaced apart fins positioned between successive sets of said rows of substantially parallel tubes.

21. The heat and mass exchanger of claim 1 comprising at least two columns of substantially parallel tubes.

22. The heat and mass exchanger of claim 1 wherein the spaced apart fins are removable.

23. An extruded plate for use in a heat and mass exchange assembly, said plate comprising:

a substantially planar member having opposing first and second ends, and a pair of opposing outer heat transfer surfaces disposed on the exterior portion thereof;

a plurality of parallel interior channels extending longitudinally within the substantially planar member from the first end to the second end, and coextensively within and directly between the pair of opposing outer transfer surfaces, said plurality of parallel interior channels including webs each fluidly partitioning adjacent interior channels from one another;

a fluid inlet for passing a fluid into a first group of said plurality of parallel interior channels;

a fluid outlet for passing a fluid out of a second group of said plurality of parallel interior channels; and fluid communication means for passing a fluid between the first group and the second group of said plurality of parallel interior channels to provide a continuous fluid flow path with multiple passes within and parallel along the pair of opposing outer heat transfer surfaces of the substantially planar member from the fluid inlet to the fluid outlet, wherein the fluid passing within the fluid communication means is flowing in the same plane as the fluid passing through the parallel interior channels.

24. The extruded plate of claim 23 wherein the fluid communication means comprises through holes positioned in the webs.

25. The extruded plate of claim 24 wherein the through holes comprises rows of bores intersecting the channels at an angle.

* * * * *